US012121087B2

(12) United States Patent
Intihar

(10) Patent No.: US 12,121,087 B2
(45) Date of Patent: Oct. 22, 2024

(54) HEAD WORN AND SWING ARM MOUNTED MASK

(71) Applicant: Shane Intihar, Arlington, VA (US)

(72) Inventor: Shane Intihar, Arlington, VA (US)

( * ) Notice: Subject to any disclaimer, the term of this patent is extended or adjusted under 35 U.S.C. 154(b) by 305 days.

(21) Appl. No.: 17/455,124

(22) Filed: Nov. 16, 2021

(65) Prior Publication Data

US 2022/0151317 A1 May 19, 2022

Related U.S. Application Data

(60) Provisional application No. 63/114,299, filed on Nov. 16, 2020.

(51) Int. Cl.

| | |
|---|---|
| ***A42B 3/28*** | (2006.01) |
| ***A41D 13/11*** | (2006.01) |
| ***A42B 3/18*** | (2006.01) |

(52) U.S. Cl.
CPC ..... *A41D 13/1161* (2013.01); *A42B 3/18* (2013.01)

(58) Field of Classification Search
CPC ..... A41D 13/1161; A41D 13/11; A42B 3/18; A42B 3/222; A42B 3/288
See application file for complete search history.

(56) References Cited

U.S. PATENT DOCUMENTS

| | | | | |
|---|---|---|---|---|
| 3,649,964 | A * | 3/1972 | Schoelz | A61F 9/068 128/205.25 |
| 4,185,329 | A * | 1/1980 | Sarazen | A61F 9/061 2/428 |
| 4,222,123 | A * | 9/1980 | Hellberg | A61F 9/06 2/10 |
| 4,937,879 | A * | 7/1990 | Hall | A61F 9/061 2/8.3 |
| 5,191,468 | A * | 3/1993 | Mases | A61F 9/065 359/361 |
| 5,946,719 | A * | 9/1999 | Crupi | F41H 1/02 2/9 |
| 7,934,847 | B2 * | 5/2011 | Oomori | B25F 5/021 408/16 |
| 2020/0221796 | A1 * | 7/2020 | Moon | A62B 9/04 |
| 2020/0338294 | A1 * | 10/2020 | McLauren | A61M 16/0816 |
| 2023/0232931 | A1 * | 7/2023 | Lu | A42B 3/225 2/195.1 |

* cited by examiner

*Primary Examiner* — Tajash D Patel
(74) *Attorney, Agent, or Firm* — Scott C Harris, Esq

(57) ABSTRACT

A head mounted face mask assembly wherein the face mask is connected to a headmounted device via articulatable swing arms. The assembly is configured so that the weight of the face mask is borne entirely by the swing arms and, in turn, the headmounted device. The swing arms can pivot relative to the headmounted device, and also mid arm, and also where the lower arms connect with the face mask itself.

22 Claims, 17 Drawing Sheets

HEAD WORN AND SWING ARM MOUNTED MASK

This application claims priority from Application No. 63/114,299, filed Nov. 16, 2020, the entire contents of which are herewith incorporated by reference.

BACKGROUND

Face masks are used, and in fact sometimes required, when carrying out certain activities in both public and private settings. Face masks are also used by people who suffer from allergic reactions to allergens in the atmosphere, both outdoors and indoors and in public and private settings.

Users will often take their face masks off when, for instance, no one is close by and there is no danger of spreading or contracting diseases; or when the user wishes to eat or drink. However, putting on or taking off a conventional face mask can be difficult, inconvenient and/or unhygienic, particularly when the user is simultaneously enaged in another activity.

In addition, the temporary storage of a conventional face mask after it has been temporarily removed can be difficult, inconvenient and/or unhygienic, particularly when the user is simultaneously enaged in another activity.

It is also important to obtain a sufficiently tight seal between the face mask and the user's face. This can be difficult to achieve, particularly without causing discomfort to the user or marring the user's face.

It is also important, particularly where the user is engaged in vigorous exercise or labor, to prevent the face mask's filter from absorbing too much perspiration and to maximize air-flow through the face mask's filter.

SUMMARY OF THE INVENTION

The inventor recognized that putting on or taking off a conventional face mask can be difficult, inconvenient and/or unhygienic, particularly when the user is simultaneously enaged in another activity.

The inventor further recognized that the temporary storage of a conventional face mask after it has been temporarily removed can be difficult, inconvenient and/or unhygienic, particularly when the user is simultaneously enaged in another activity.

The inventor further recognized that it is important to achieve a sufficiently tight seal between the face mask and the user's face and that this can be difficult to achieve without causing discomfort to the user or marring the user's face.

The inventor further recognized that it is important, particularly where the user is engaged in vigorous exercise or labor, to prevent the face mask's filter from absorbing too much perspiration and to maximize air-flow through the face mask's filter, and that a conventional face mask that achieves the foregoing may be relatively heavy and require substantial lateral force against the face in order to keep the face mask in place.

An embodiment describes a mask system, where the mask is held by swing arms attached to a headmounted device. The mask can employ a wide variety of replacable filters, including filters for allergens, dust and/or infectious diseases. Any type of mask or respirator can be mounted on the swing arms.

Different embodiments describe different aspects of the invention and the different advantages thereof.

BRIEF DESCRIPTION OF THE DRAWINGS

In the Drawings.

the figures show different aspects of the invention and specifically.

DETAILED DESCRIPTION

Figure 1A:
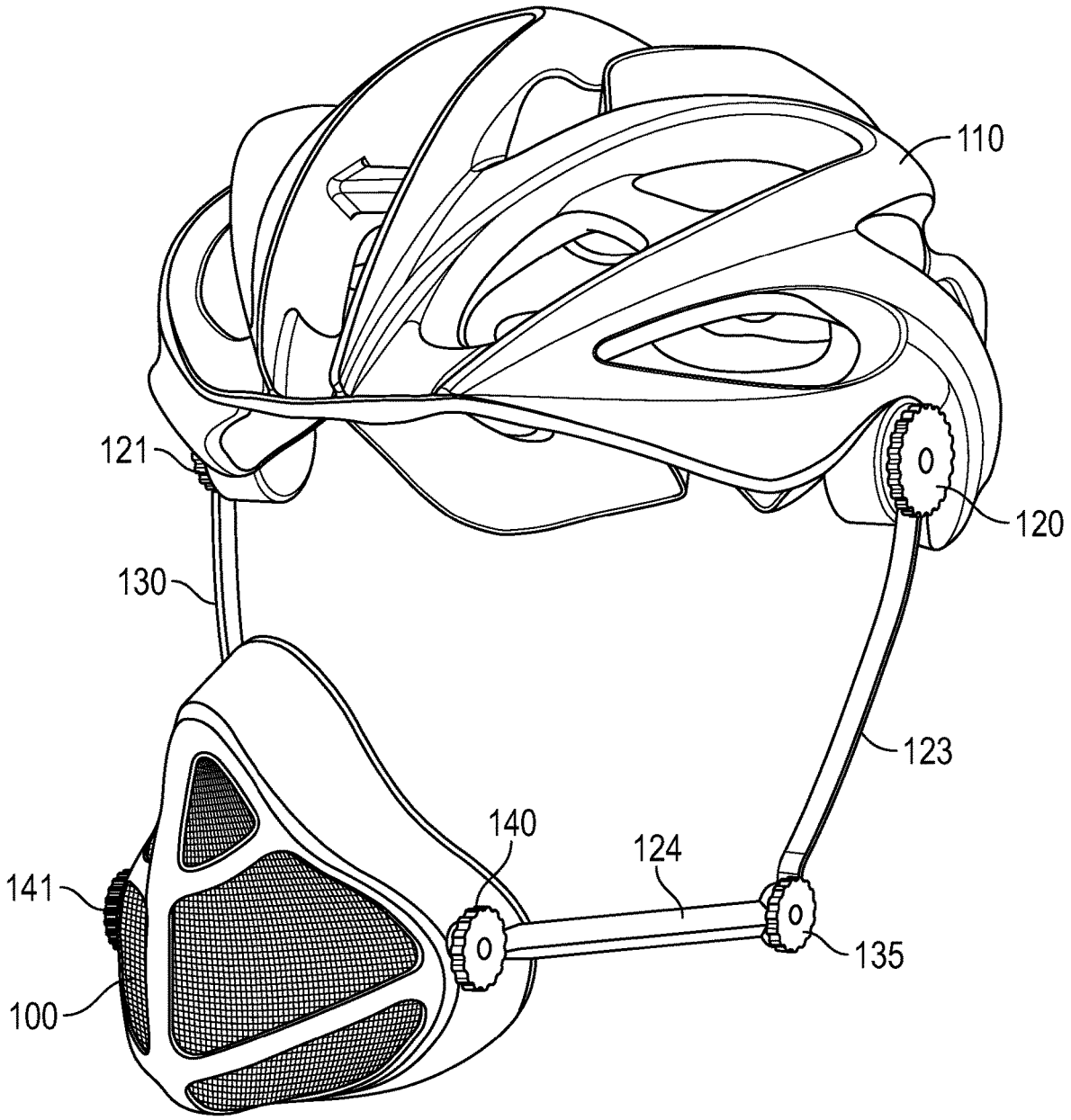
FIGS. 1A and 1B show a first embodiment where the face mask is attached to a bicycle helmet.

The present application describes a mask mounted on articulating swing arms connected to a headmounted device. The headmounted device has surfaces that hold to the head of the user. The mask has surfaces that cover the nose and mouth of the user, extend around the nose and mouth, and can form a sealing surface around the nose and mouth, thus causing the user to breathe through the filtering material of the mask. That filtering material can be a medical grade filtering material such as an N95 or KN95 face mask material, or can be a different kind of fabric or cloth material.

In different embodiments, the headmounted device can be items including a head harness, hard hat, or helmet, such as a bike helmet. The headmounted device can be, for example, used in home and fitness applications, used in industrial applications or used in sports applications.

FIGS. 1A, 1B and 2A, 2B and 2C show a first embodiment, where the mask 100 is mounted on a headmounted device which in this embodiment is a bicycle helmet 110. The bicycle helmet 110 connects to articulated arms which allow movement of the mask 100 as described herein. The arms move on a first movement axis defined by a first hinge point 120/121 which are on opposite sides of the mask and which respectively hold articulating swing arms. The hinge point 120 holds a first swing arm formed of two hinged arm parts 123 and 124. A hinge part 135 is located between the upper part 123 and lower part 124 of the arm, to allow the upper and lower parts of the arm, 123 and 124, to be adjusted into a desired location. The hinge part 135 defines a second movement axis.

Similarly, the hinge point 121 holds its own second swing arm formed of two hinged arm parts, 130 and 131. An identical hinge part, 136, is located between the upper and lower parts of this arm, 130 and 131.

In one embodiment, hinge parts 135 and 136 use molded silicon or closed-cell polyurethane foam rubber (or similar rubber) washers, which are sandwiched between the parts that form hinges 135 and 136, i.e., respectively, parts 123 and 124 and parts 130 and 131. Tightening adjustment knobs are located on the outside of hinge parts 135 and 136. Compression created by the tightening adjustment knobs, will hold the lower part of the arms in place relative to the upper part of the arm. The elasticity of the silicon and rubber washers permits the lower part of the arms to move slightly when upward or downward pressure is applied to the mask (for instance, when the user opens his or her mouth) and to return to the starting position automatically after the pressure subsides.

Hinge points 120 and 121 use rubber washers and the compression created by the tightened adjustment knobs (located on the outside of hinge parts 120 and 121) to hold the upper parts of the arms in place.

The mask can rotate axially on a third set of pivot points 140, 141, where the mask connects to the swing arms.

Figure 1B:
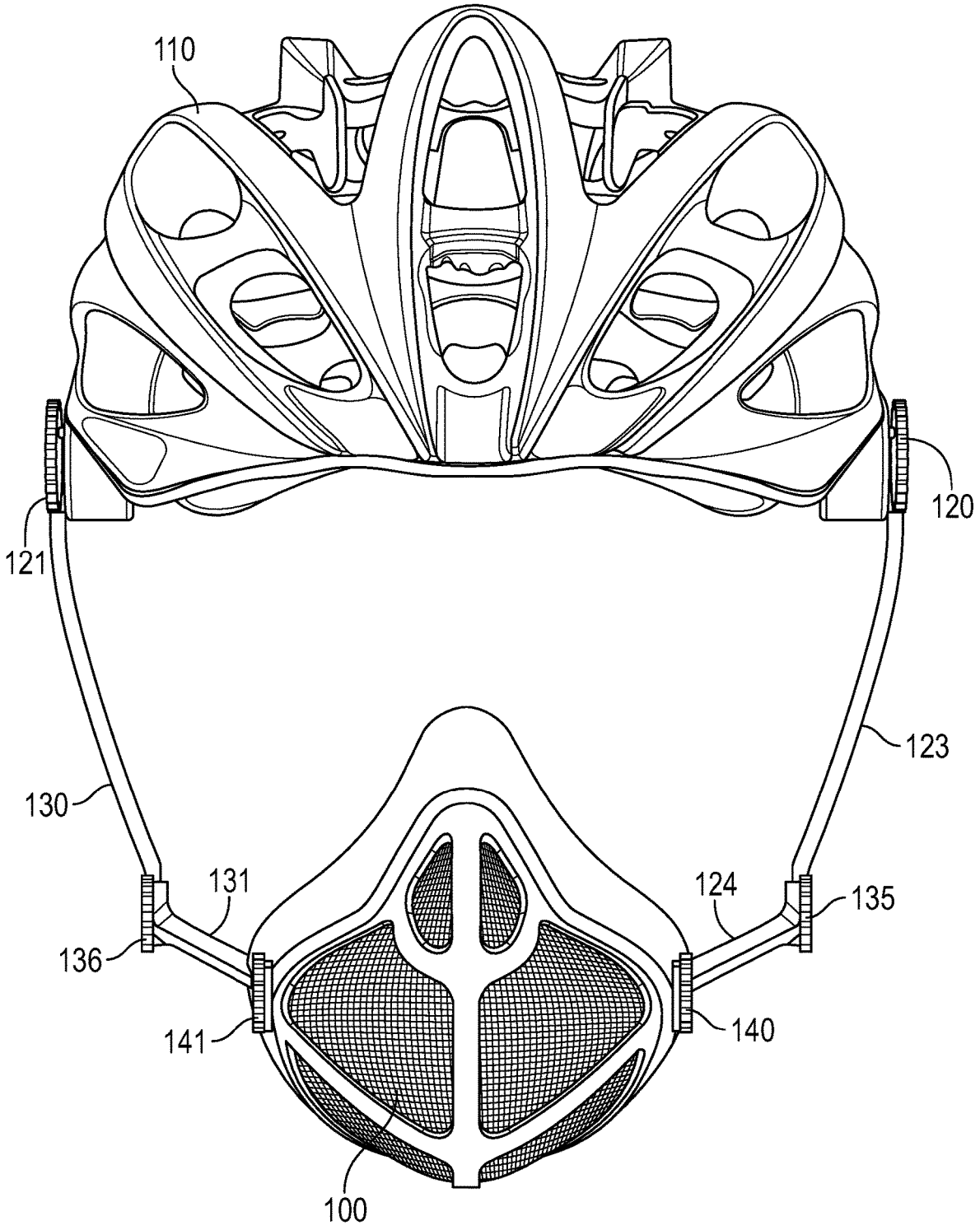

Each of the swing arms has a pivot point on the headmounted device shown in FIGS. 1A and 1B as 120, 121. Each of the swing arms also has an elbow joint shown as 135, 136 in FIGS. 1A and 1B. The mask can rotate axially on a third set of pivot points, shown as 140, 141 in FIGS. 1A and 1B, where the mask connects to the swing arms. Together, these three different kinds of adjustments allow for fine positioning of the mask by the user to maximize comfort.

In another embodiment ("Embodiment M," depicted in detail in FIGS. 4A, 4B, and 4C and 7A and 7B), the upper part of the arms are held in place by the attractive force between a magnet mounted on an adjustable carriage (431 and 721) and a metal plate embedded in the upper part of each arm, 433 and 724.

As part of Embodiment M, the position of the carriage can be adjusted along a track (434 and 725) by turning an adjustment knob (432 and 722) to allow the user to adjust the location of the upper arms and, consequently, the mask to accommodate the user's particular head and face size and dimensions and to achieve the desired level of compression of the flange against the user's face.

As part of Embodiment M, the upper hinge points do not use a rubber or elastomeric washer. Instead, in order to keep the mask in the down position, Embodiment M uses the magnetic catch system shown in FIG. 4C and described above.

Figure 5A:
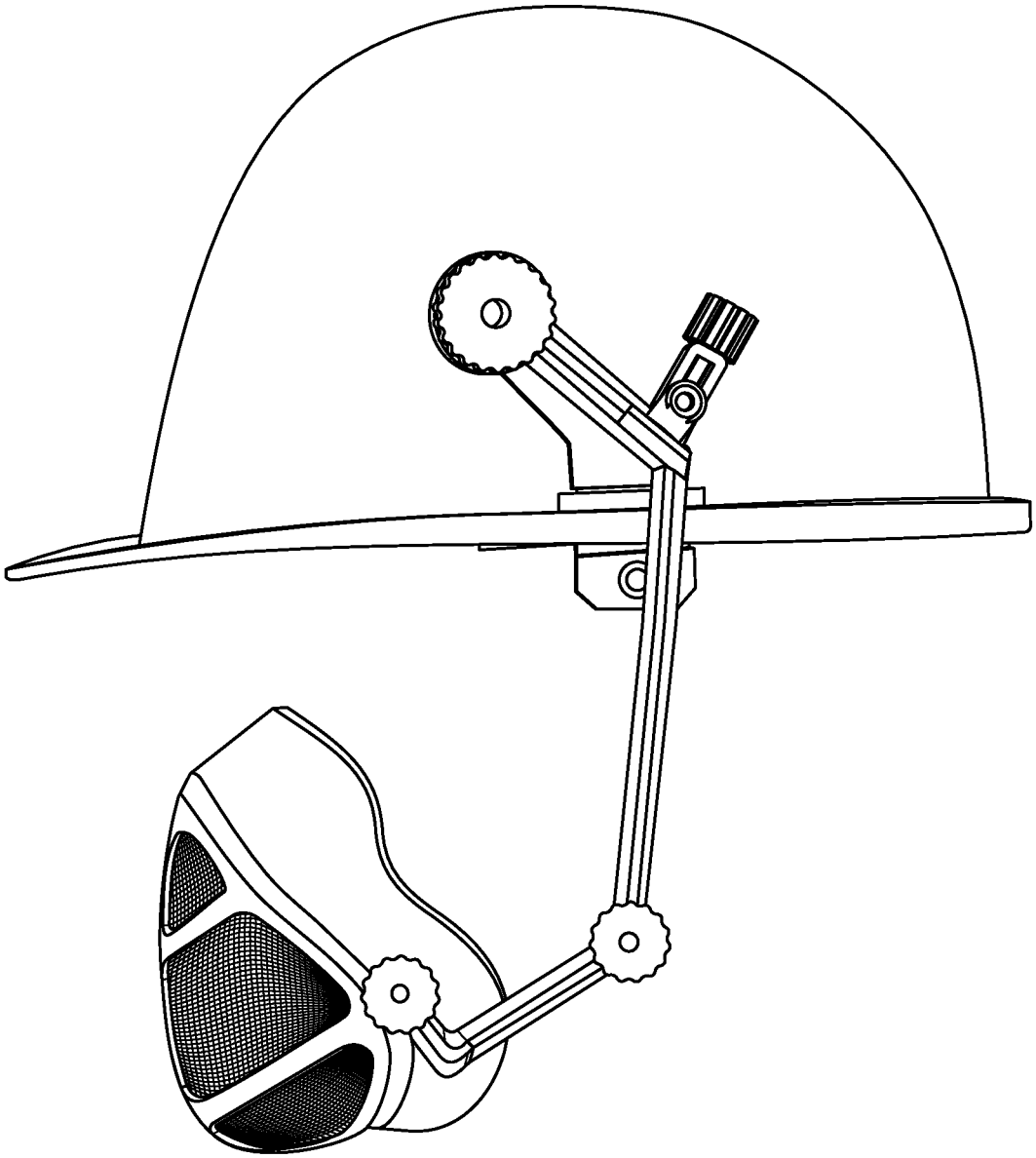
FIGS. 5A, 5B, 5C and 5D show respectively different positions of the mask of FIGS. 4A-4C.
Figure 5B:
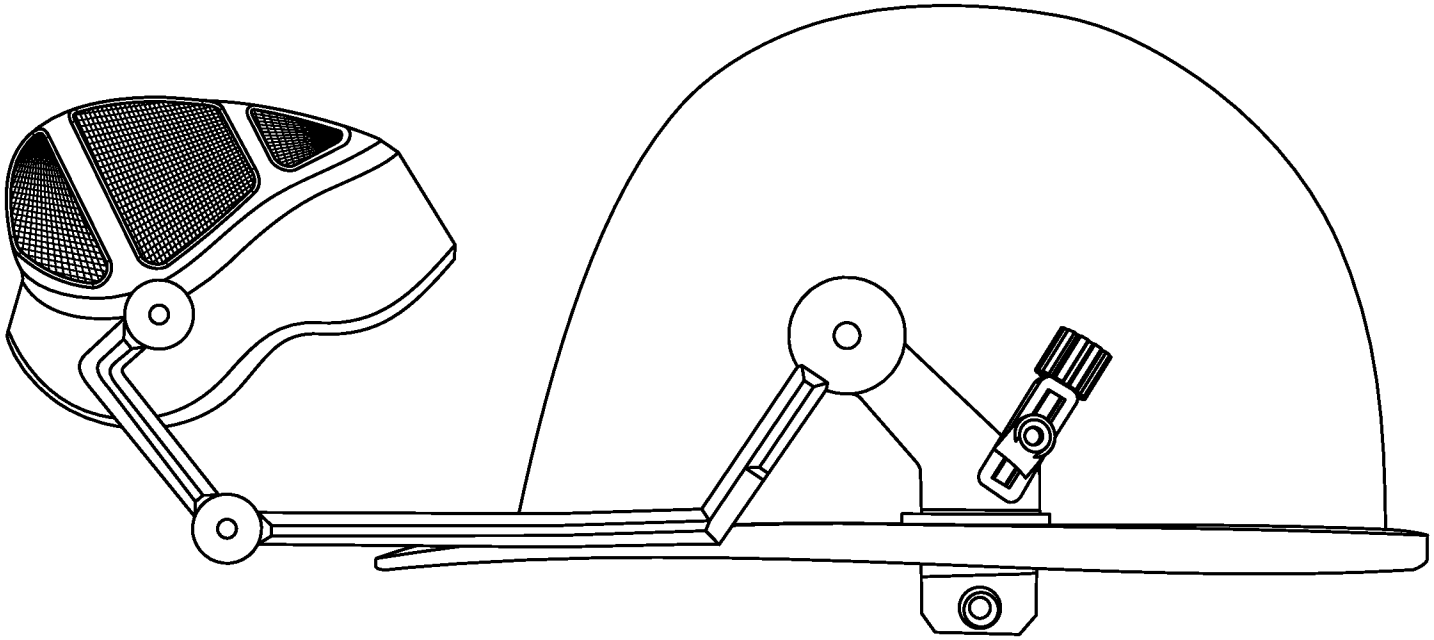
Figure 5C:
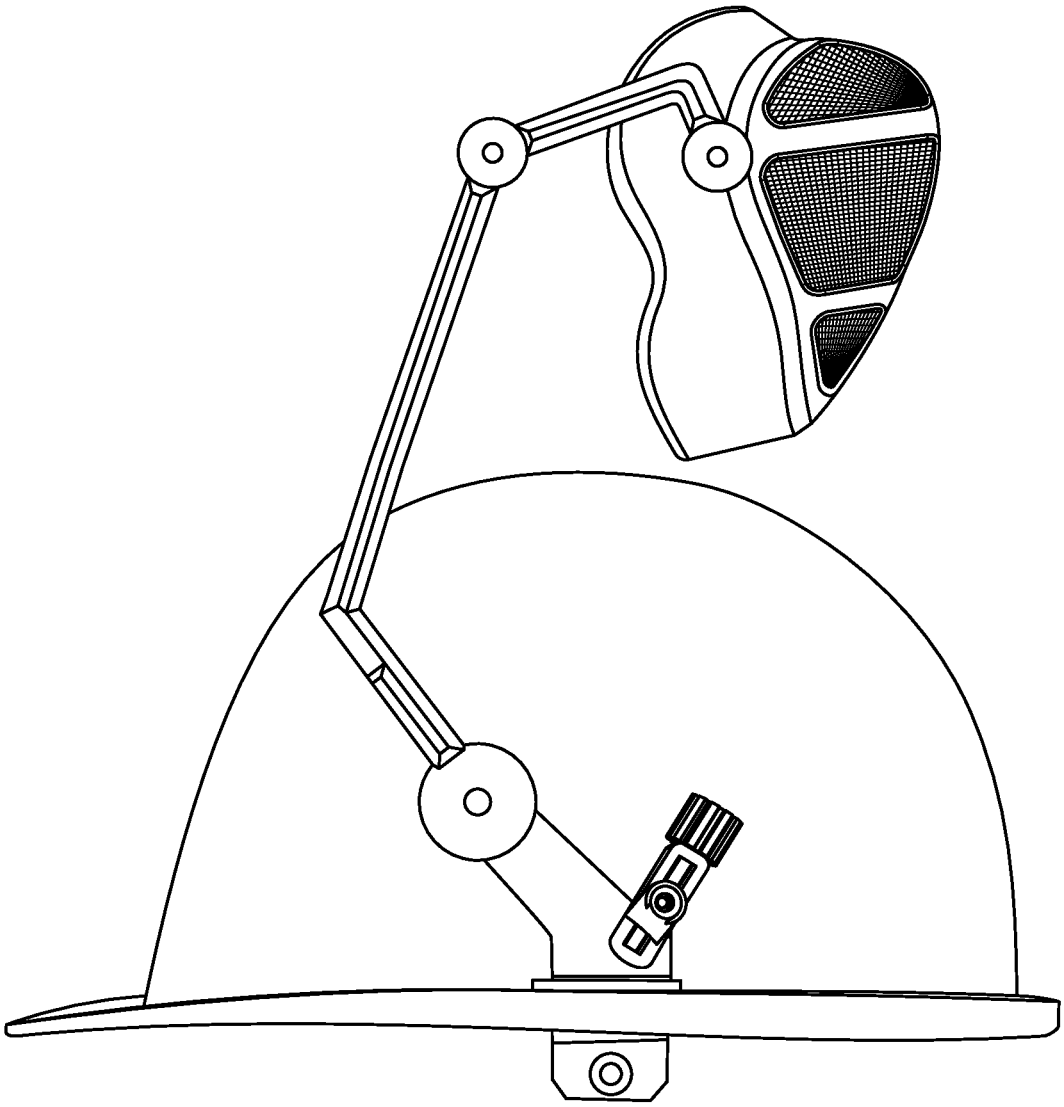
Figure 5D:
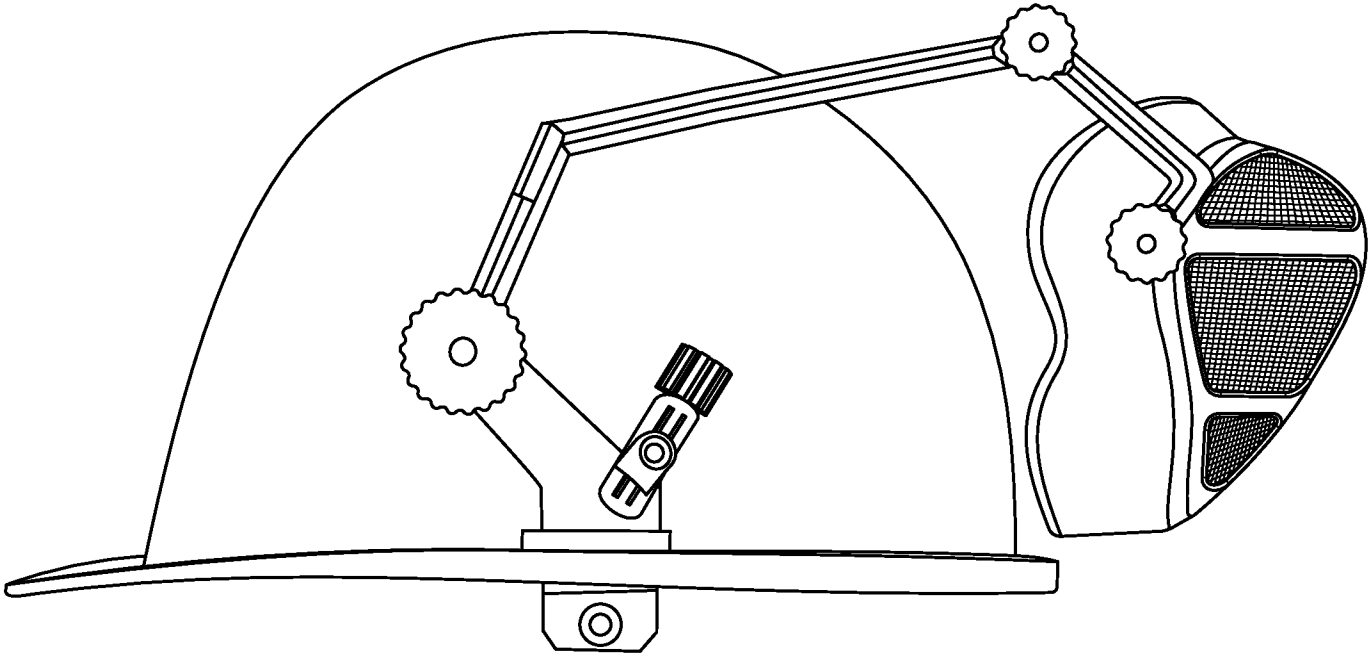

Embodiment M also employs a different mechanism for holding the upper swing arms stationary when the mask is lifted from the face to an intermediate position shown in FIG. 5B. In particular, Embodiment M uses hinge points with offset raised areas 429, 430 on the surfaces 441, 442 where the uppermost hinge points interface. These offset raised areas 429, 430 only come into contact with each other at a particular part of the arc formed by the rotation of the hinge. This allows the upper arms to move freely without resistance from Position A (FIG. 5A) where the mask is seated on the face, to Position B (Figure B), which is the point at which the mask is lifted to approximately the same height as the upper hinge points. At this point, the raised surfaces 429, 430 come into contact with each other resulting in additional compression. Once moved into Position B (FIG. 5B), the swing arms will remain stationary. The swing arms remain stationary because of the compression caused by the offset raised areas 429, 430, and will remain stationary unless the user moves the mask into another position. After the mask is move upward away from Position B (FIG. 5B), the raised surfaces lose contact, which allows the mask to easily traverse through Position C (FIG. 5C) and drop into Position D (FIG. 5D) with minimal effort by the user.

All of the hinges of all the embodiments can be held by friction or another mechanism, and can be selectively tightened and loosened or can incorporate other hinge mechanics.

Figure 2A:
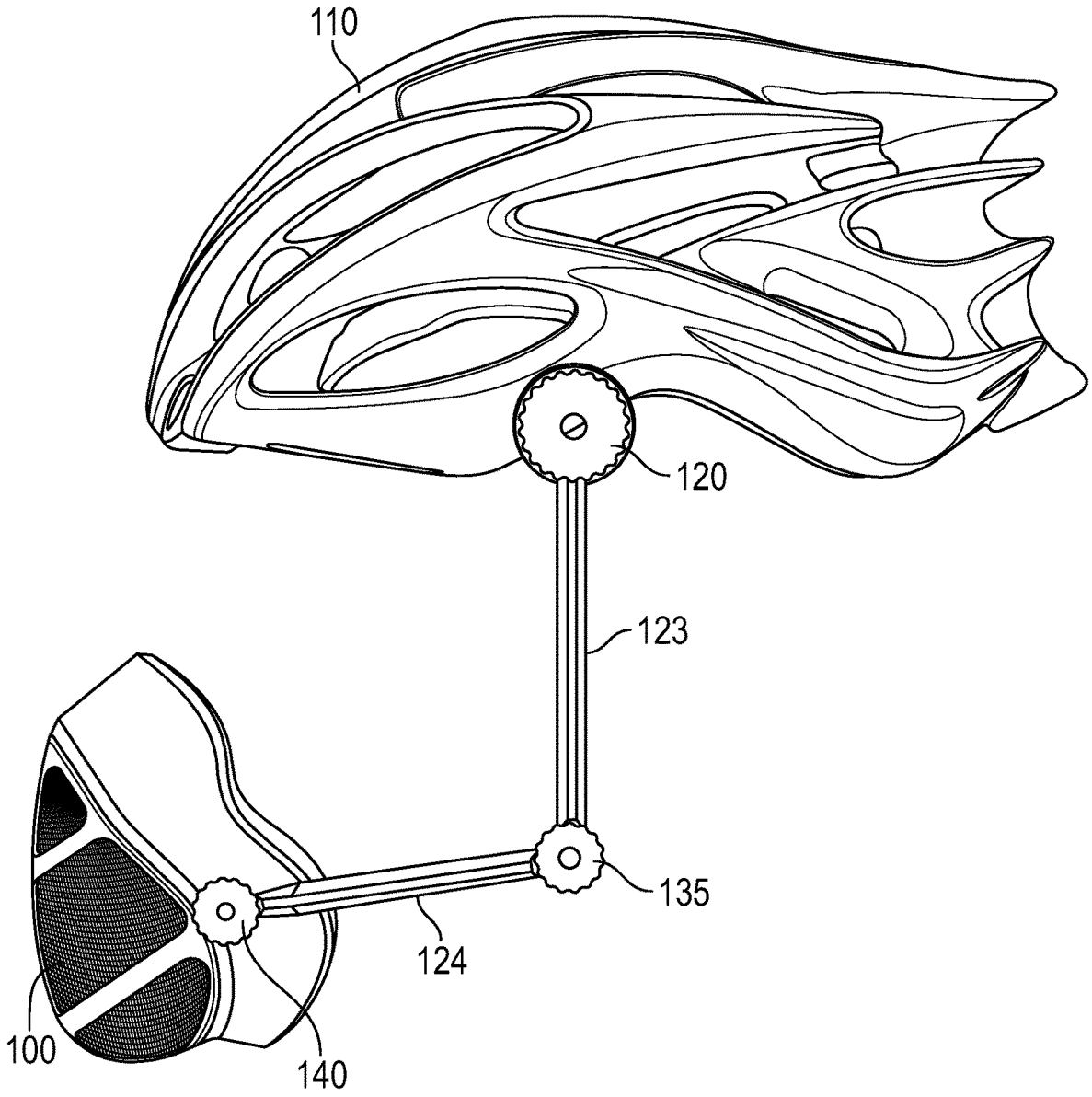
FIGS. 2A, 2B and 2C show side views of the embodiment of FIG. 1, with the mask in the down (on the face) position, raised position, and stowed position respectively.
Figure 2B:
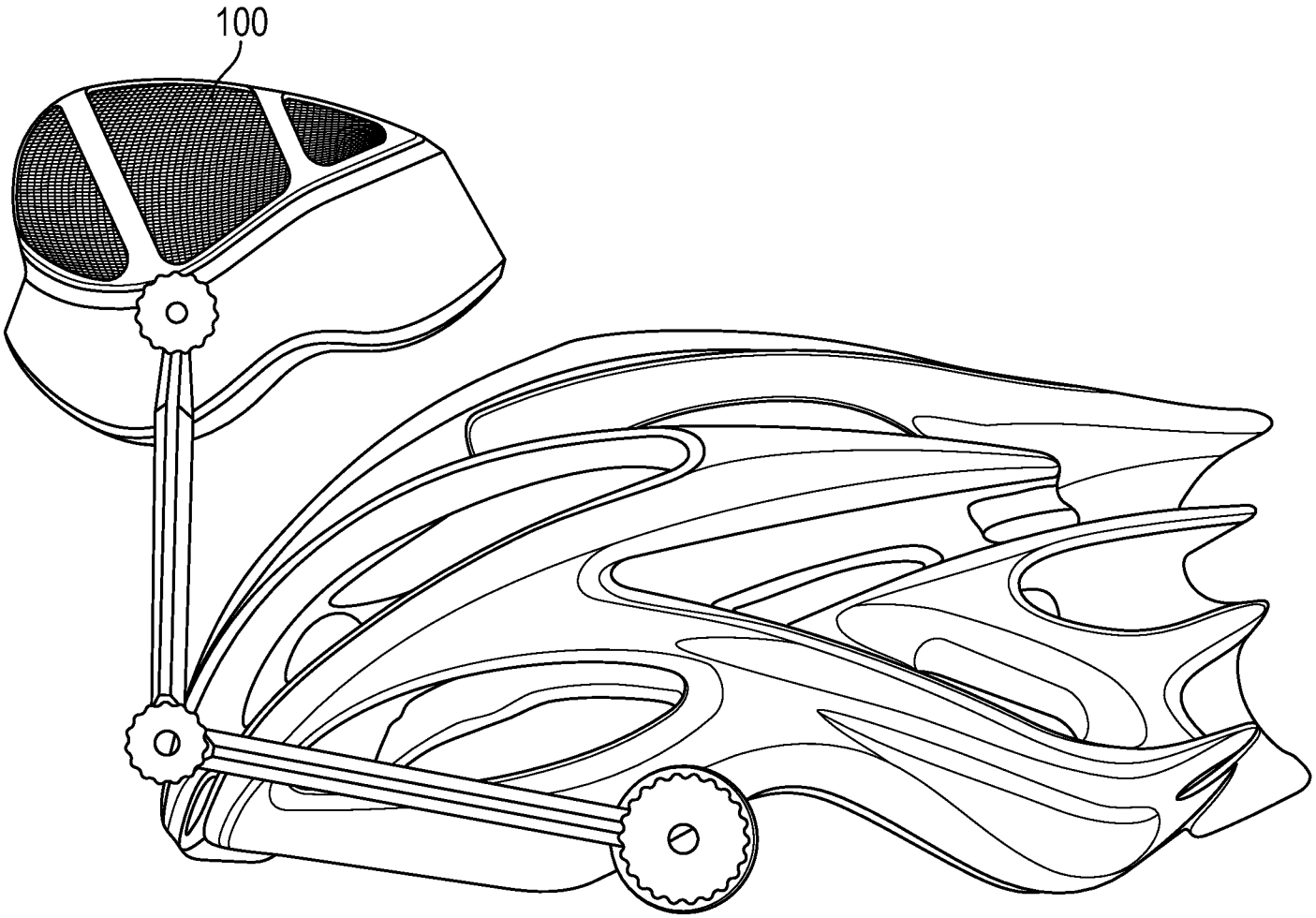
Figure 2C:
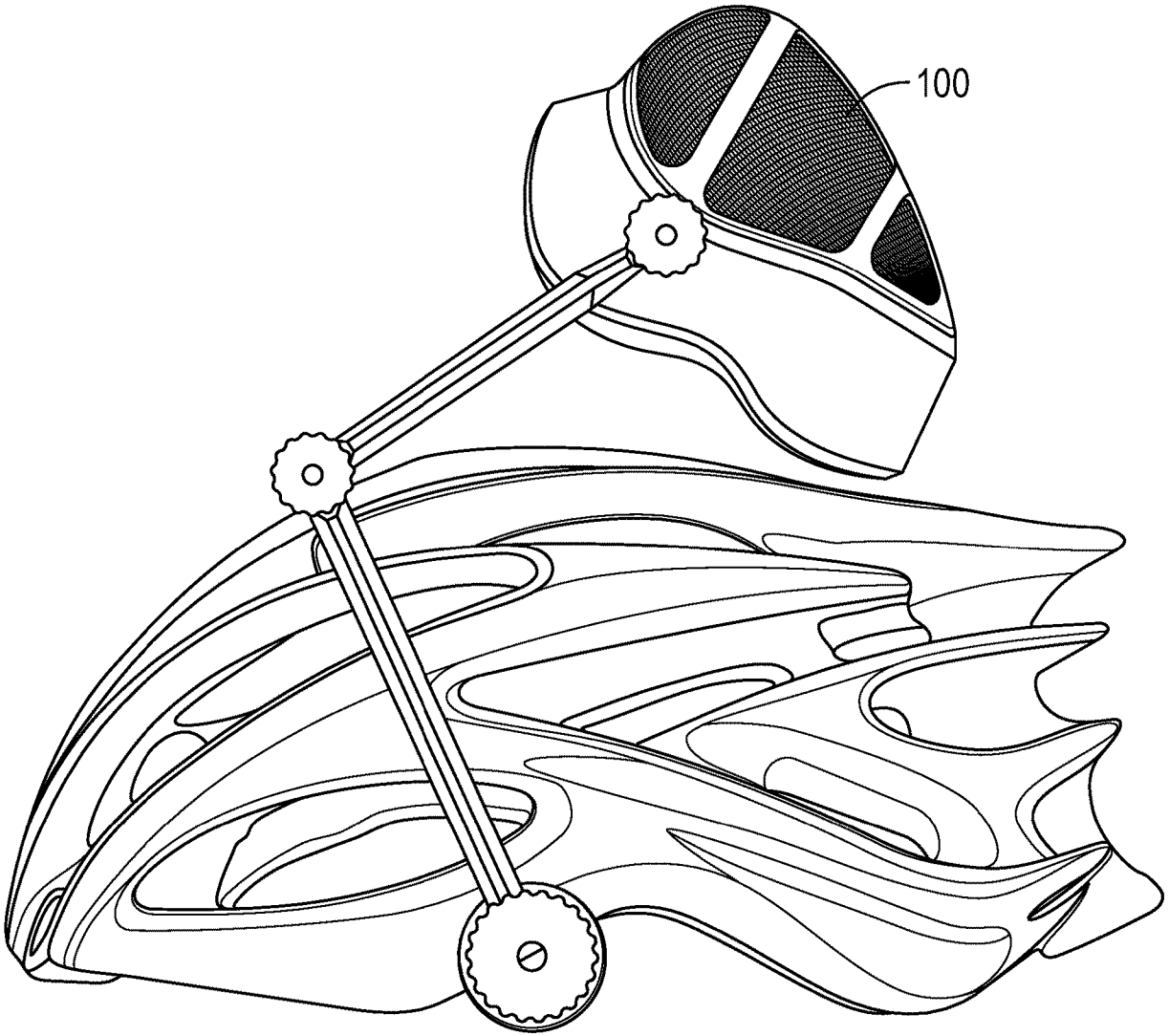

FIGS. 2A, 2B and 2C illustrate the bicycle helmet embodiment from a side view, and show how the mask can be moved from the position where the mask 100 covers the face of the user, shown in FIG. 2A, into an upright position, shown in FIG. 2B, where the mask 100 is over the head of the user. The user can still wear the helmet, but the mask is moved out of the way. The mask can be moved even further backwards, as shown in FIG. 2C, into a "stowed" position.

Figure 3:
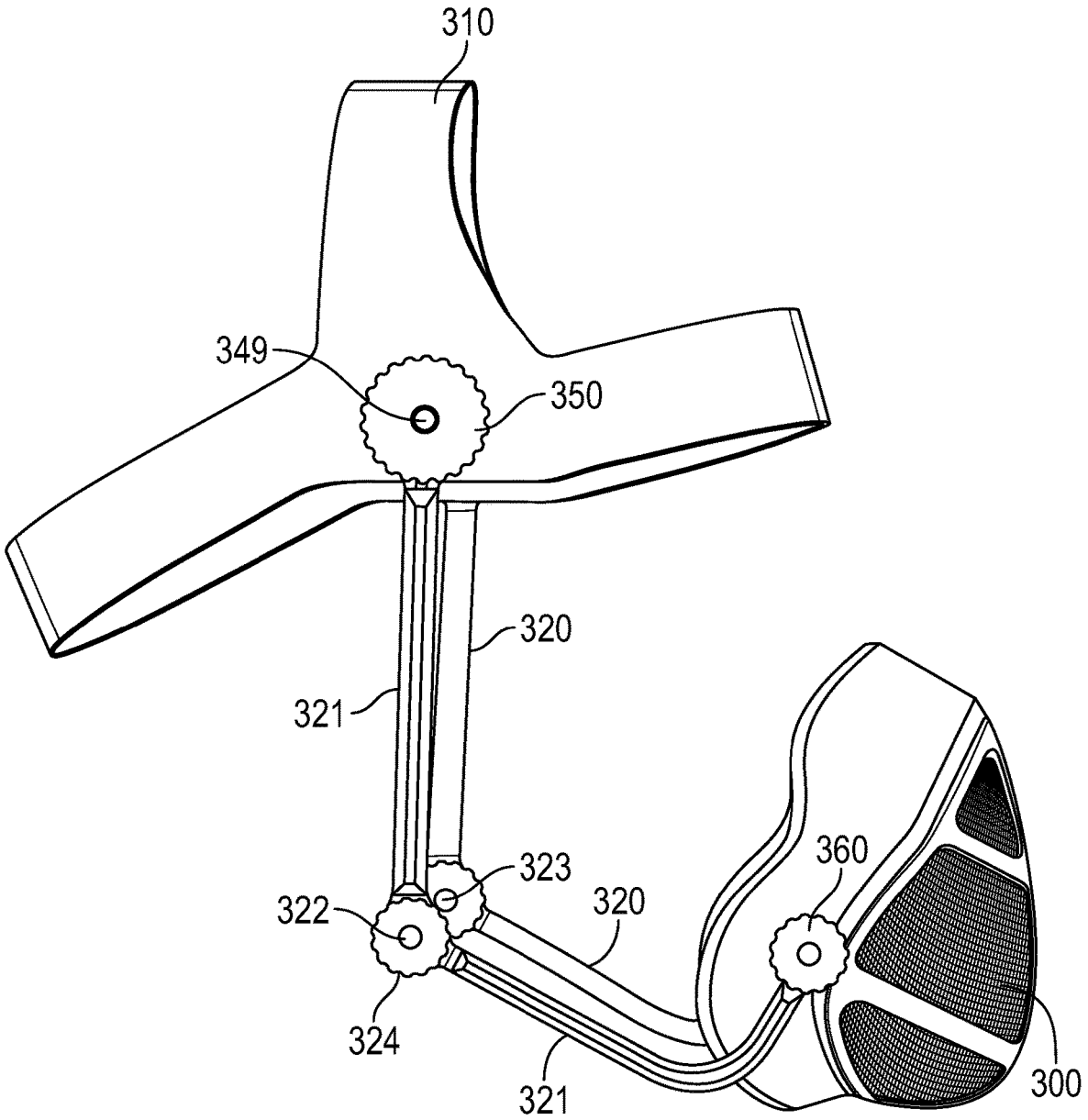
FIG. 3 shows a second embodiment mask mounted on a head harness.

FIG. 3 shows an embodiment where the mask 300 is attached to a head harness 310 via articulating arms, 320 and 321. The entire assembly is hinged on the head harness 310 at a first hinging connection 349 (and the corresponding hinging connection on the opposite side of the head harness) whose tension can be tightened by knob 350 (and by the corresponding knob on the opposite side of the head harness). This allows the user to move the mask into analogous positions to those shown in FIGS. 2B and 2C over the user's head and stowed behind the head. The mask itself can be adjusted into a comfortable position for covering the user's face using the hinging points 322, 323, which are adjustable by knob 324 and the knob that corresponds with hinge point 323. The mask itself 300 can hinge on an adjustable hinging point and knob 360 (and corresponding hinging point and knob on the opposite side of the mask). In this way, there are a number of degrees of freedom for adjustment of the mask on to the users face.

Figure 4A:
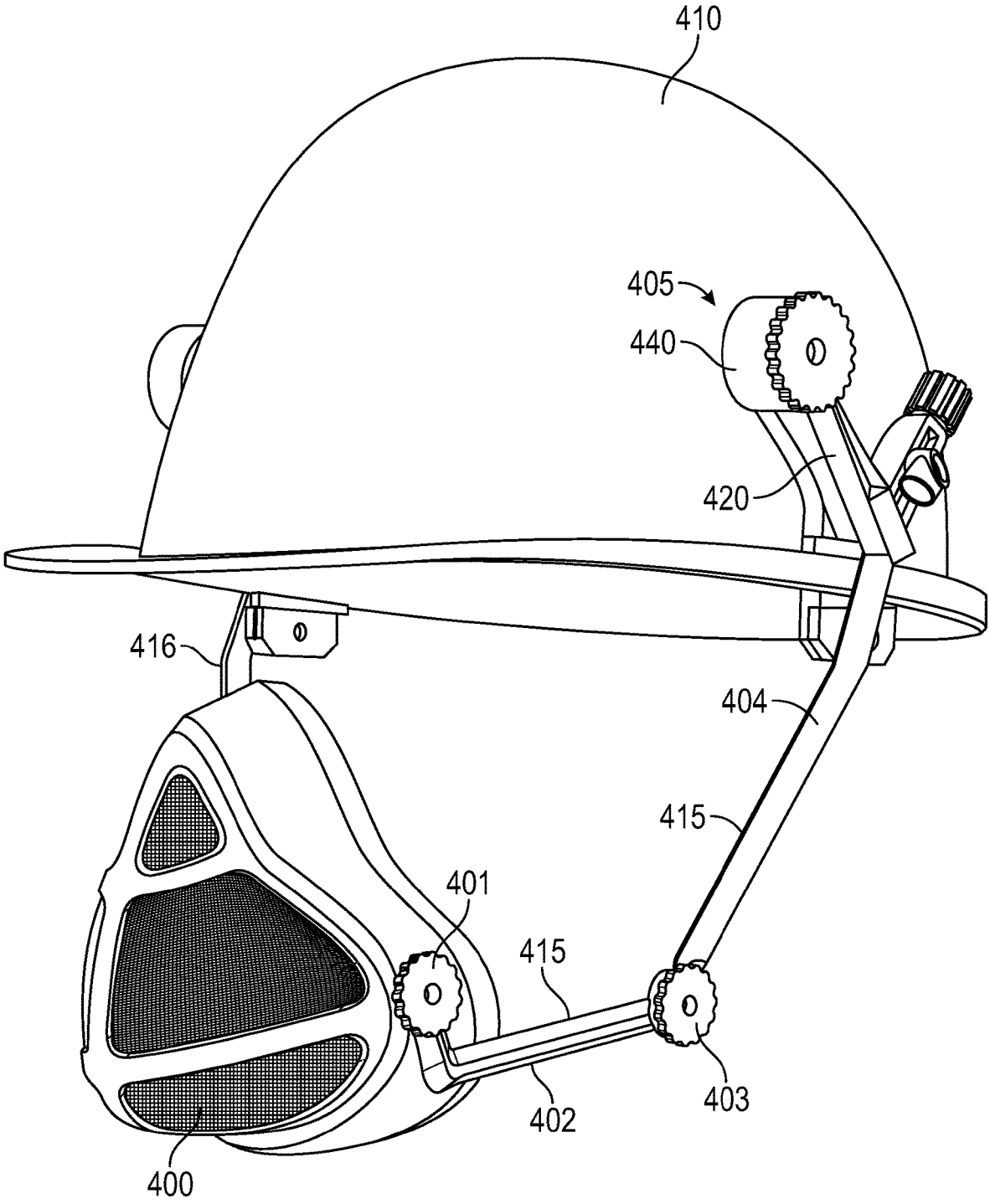
FIG. 4 a shows an embodiment of a mask mounted on a hard helmet.
FIG. 4B shows a detail of a moving part of a swing arm (in particular, an uppermost hinge point)
FIG. 4C shows details of moving parts of a swing arm (in particular, a mechanism which uses a magnet to hold the mask in the down position and which allows for micro adjustment of the tightness of the mask on the user's face)

FIG. 4A shows an embodiment where the headmounted device is a hard hat, 410, connected by articulating arms, 415 and 416, to a mask 400.

Figure 4B:
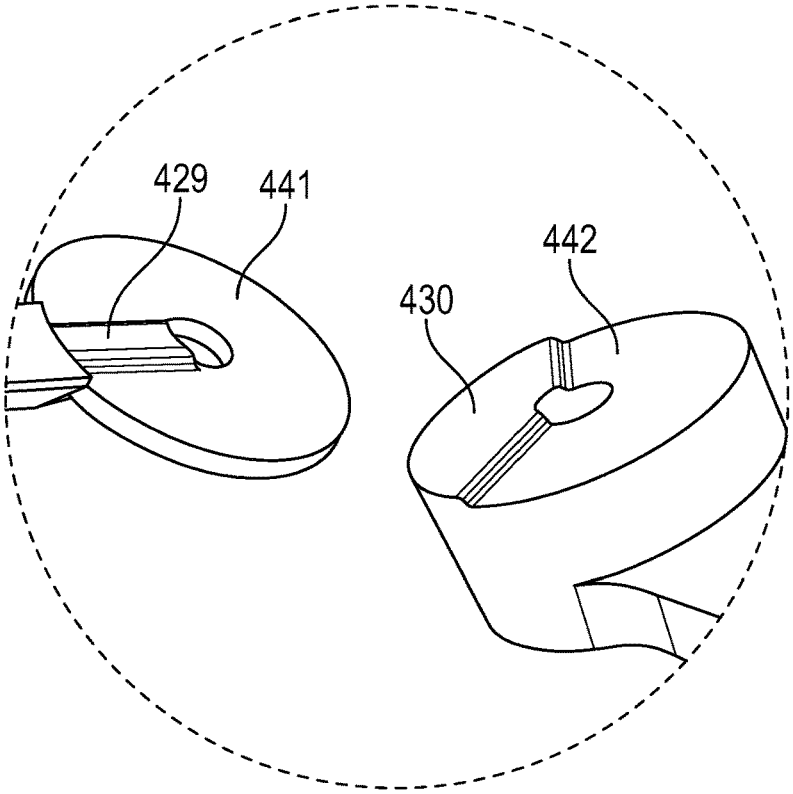
Figure 4C:
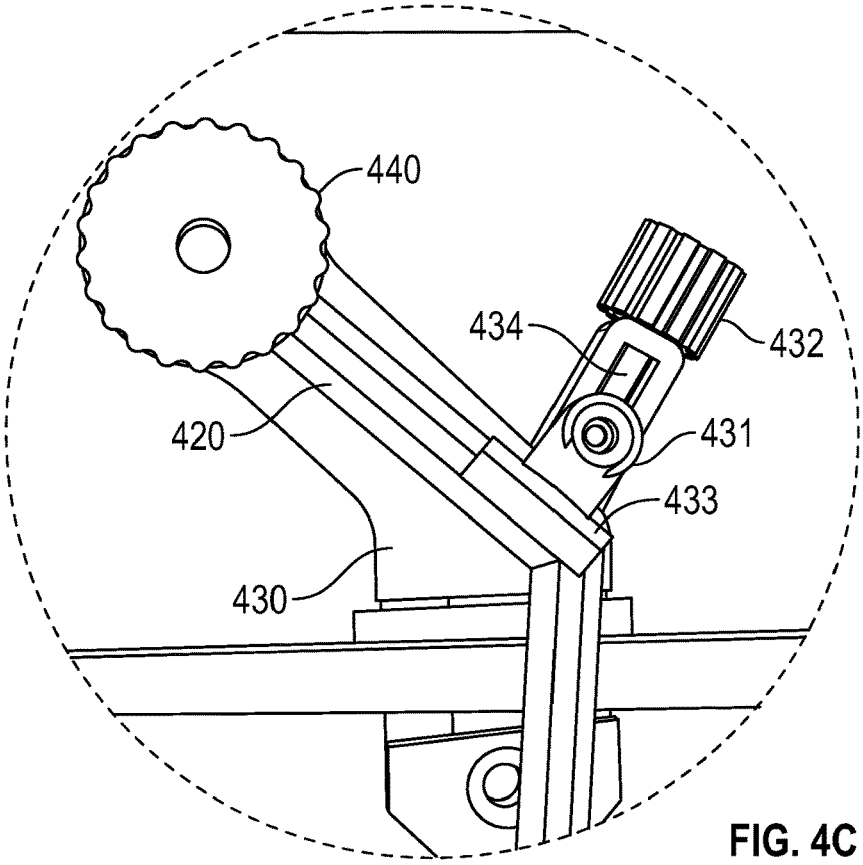

FIG. 4A illustrates the mask attached by an adjustable hinging point and knob 401 to an arm 415 formed from arm part 402, adjustable tension hinge 403, and arm part 404. The arm part 404 connects to the uppermost hinge assembly 405 whose details are shown in FIGS. 4B and 4C. The hinge assembly 405 includes an arm 420, connecting to the hinging point and knob 440. In this embodiment, the mask can be held in the intermediate position (Position B, Figure B) by the action of the surfaces (429, 430) as described herein relative to Embodiment M.

In FIGS. 4 and 5, Embodiment M is used to secure the mask in place when in the down and stowed away positions.

Figure 6:
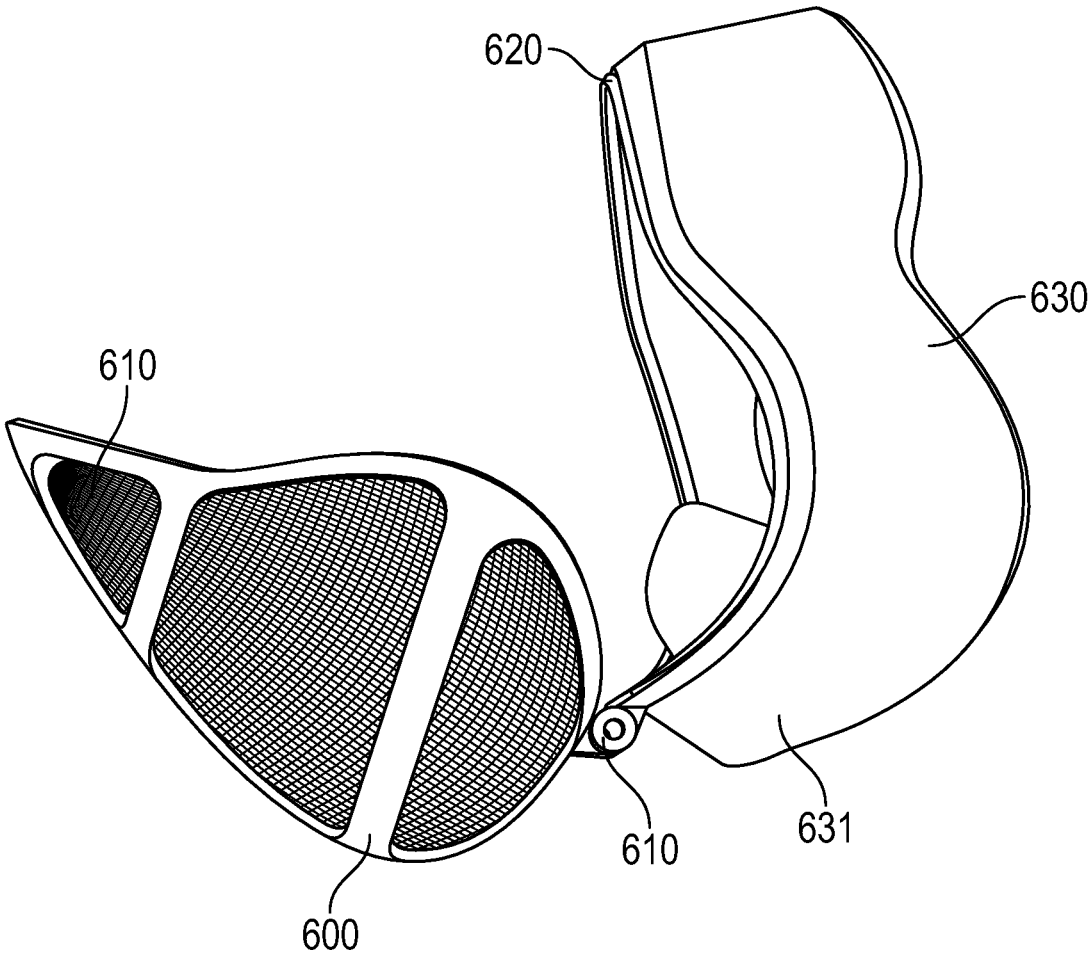
FIG. 6 shows parts of the mask in an embodiment where the mask's filter pivots relative to the face.

FIG. 6 shows an embodiment of the mask system, usable with any of the previously described embodiments, which further includes a hinged opening on the front of the mask 600 which allows the user to open the front of the mask in order to tilt the filter region downward allowing the user to drink or eat without removing the mask flange 630 from the face. In this embodiment, the the frame 601 that holds the filter is hinged on the hinging connection 610 to the frame 620 that holds the flange 630. The flange 630 has surfaces 631 which fit around and over the nose and mouth. The frame 620 is countoured and adapted to seat flush with the frame 601 that holds the filter. This enables the mask to be opened and closed using the hinge 610.

Figure 7A:
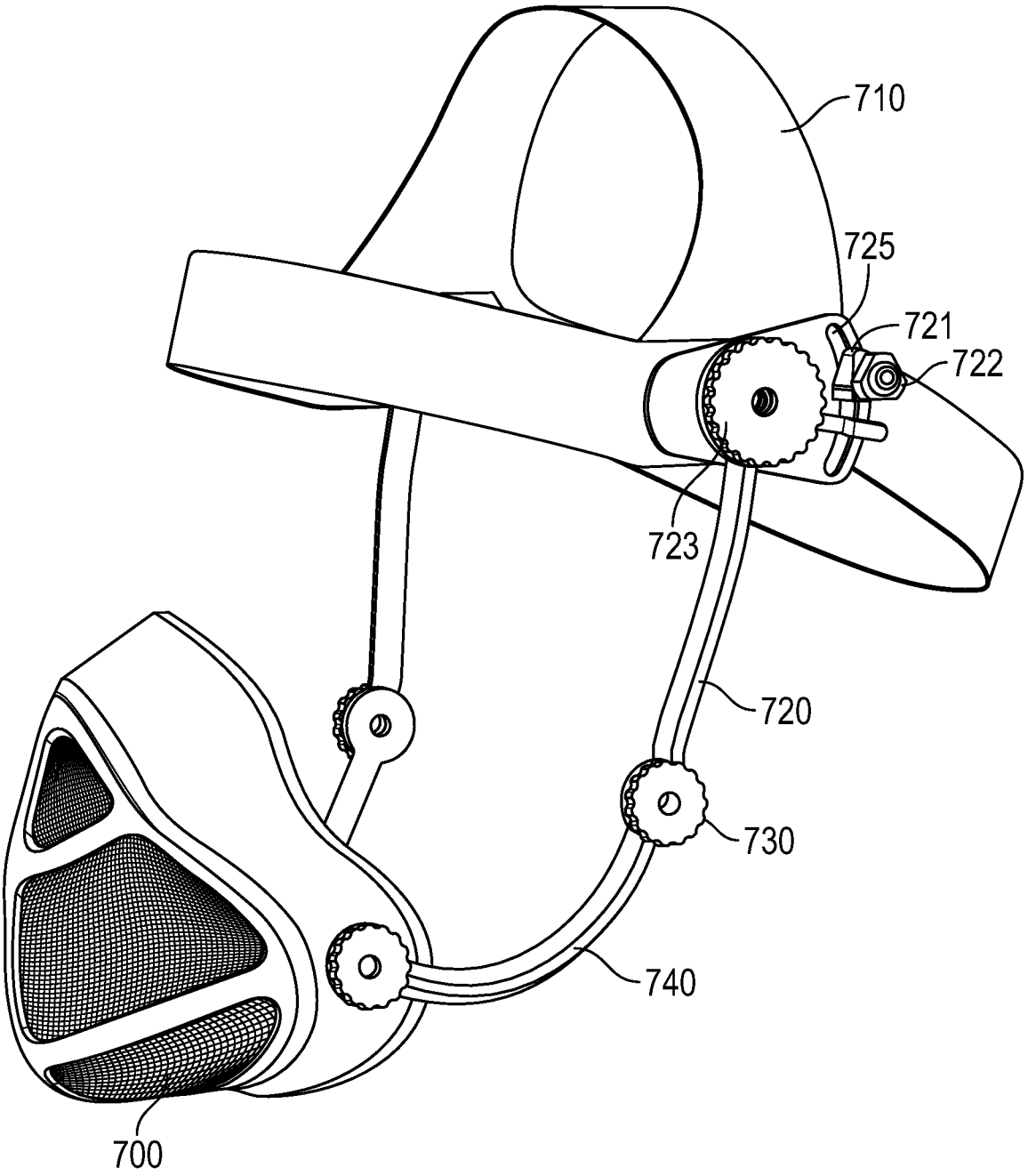
FIGS. 7A and 7B show details of the embodiments reflected in FIG. 3.
Figure 7B:
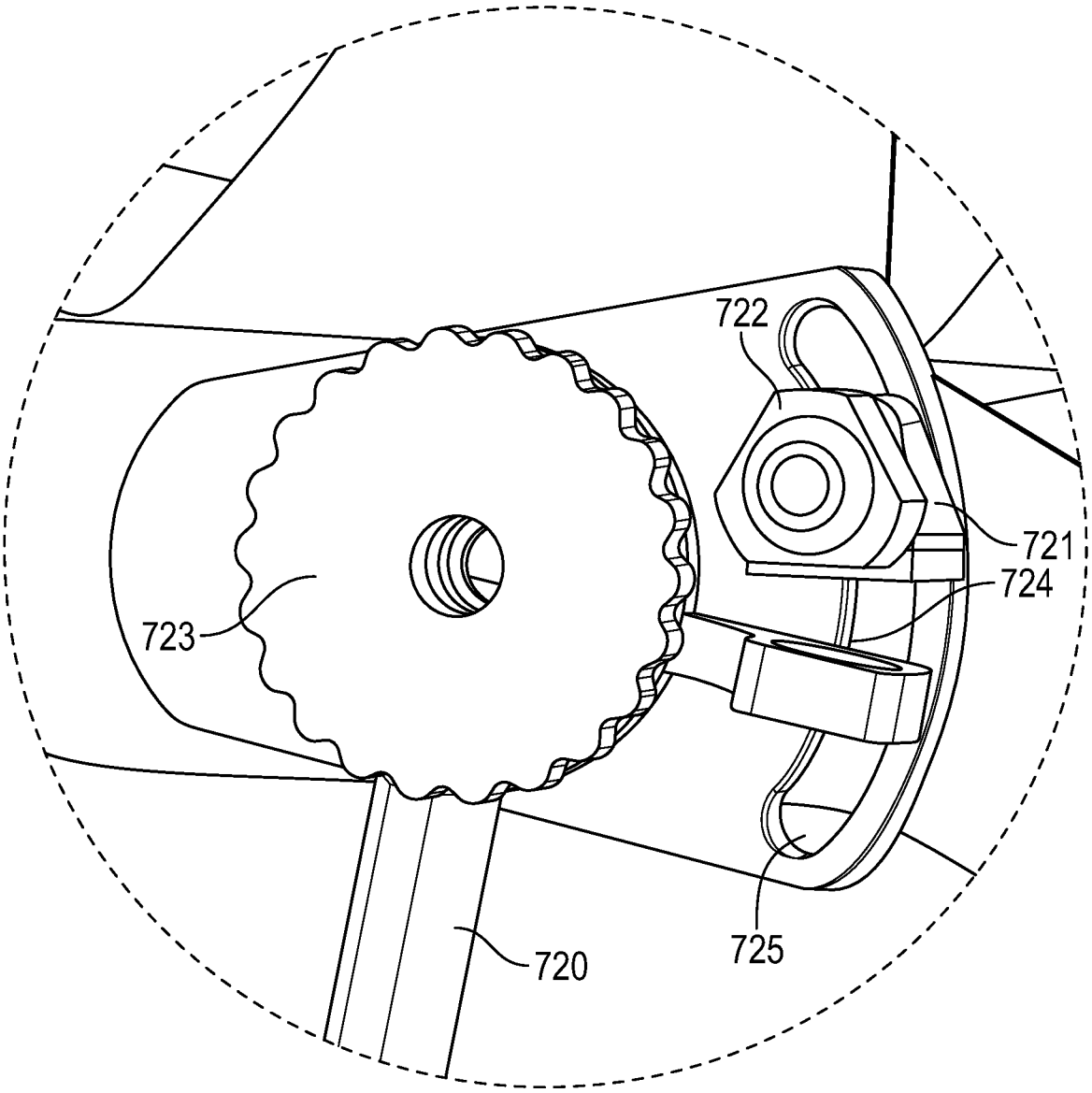

FIGS. 7A and 7B show an embodiment where the mask 700 is connected to a head harness 710, and illustrates Embodiment M employed to secure the mask in place when in the down position.

In addition, the embodiment depicted in FIG. 7A, 7B employs a pair of hinged swing arms comprised of an upper arm (720) and lower arm (740).

Figure 8A:
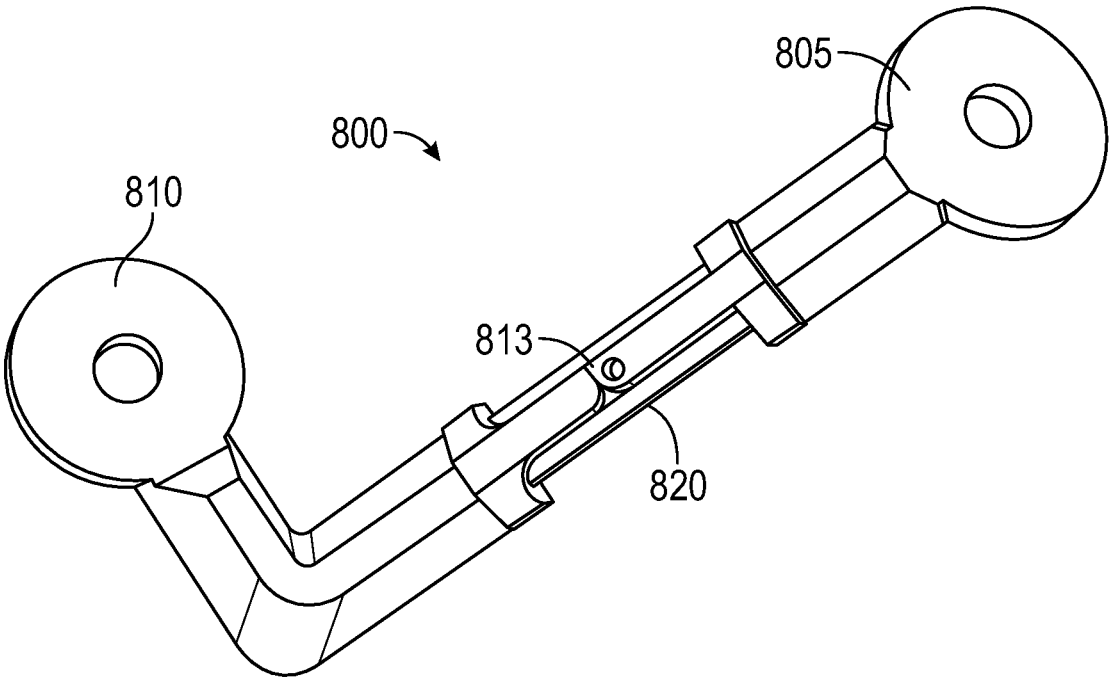
FIGS. 8A and 8B show flexible lower arms (in uncontracted and contracted positions), which are part of one of the embodiments.
Figure 8B:
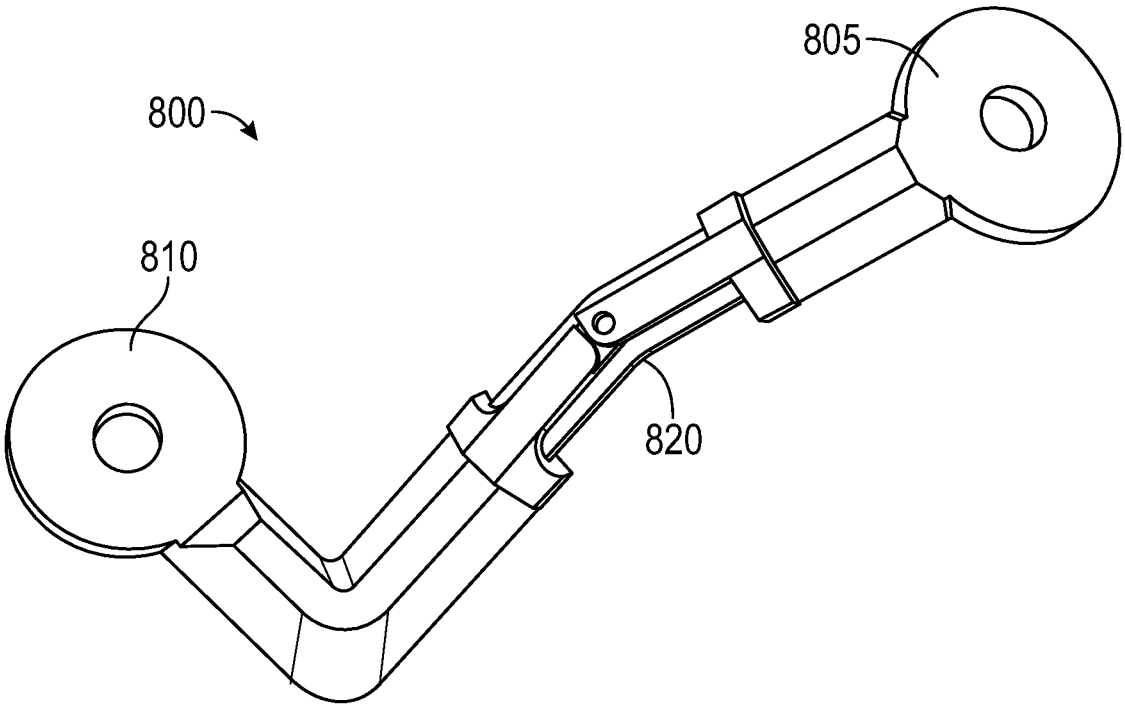

FIGS. 8A and 8B shows details of the uni-directional joint formed by parts 805 and 810 spanned by a rubber strut (820) which may be used as an alternative version of the lower arm of a swing arm to permit the mask to travel up and down and to return to its original position when, for instance, the user opens his or her mouth widely and then closes it. This version of the lower arm 800 is formed by part 805, which connects to the upper arm using a connection such as 730, and part 810, which connects to the mask. Part 805 and 810 are hinged together at hinge point 813, which allows for uni-directional movement. An elastomeric strut (820) connects parts 805 and 810 and can expand when the joint is opened (such as when a user opens his or her mouth) and will contract causing the joint to automatically return to 180 degrees when the force that caused the joint to open is withdrawn (such as when a user closes his or her mouth).

Figure 9B:
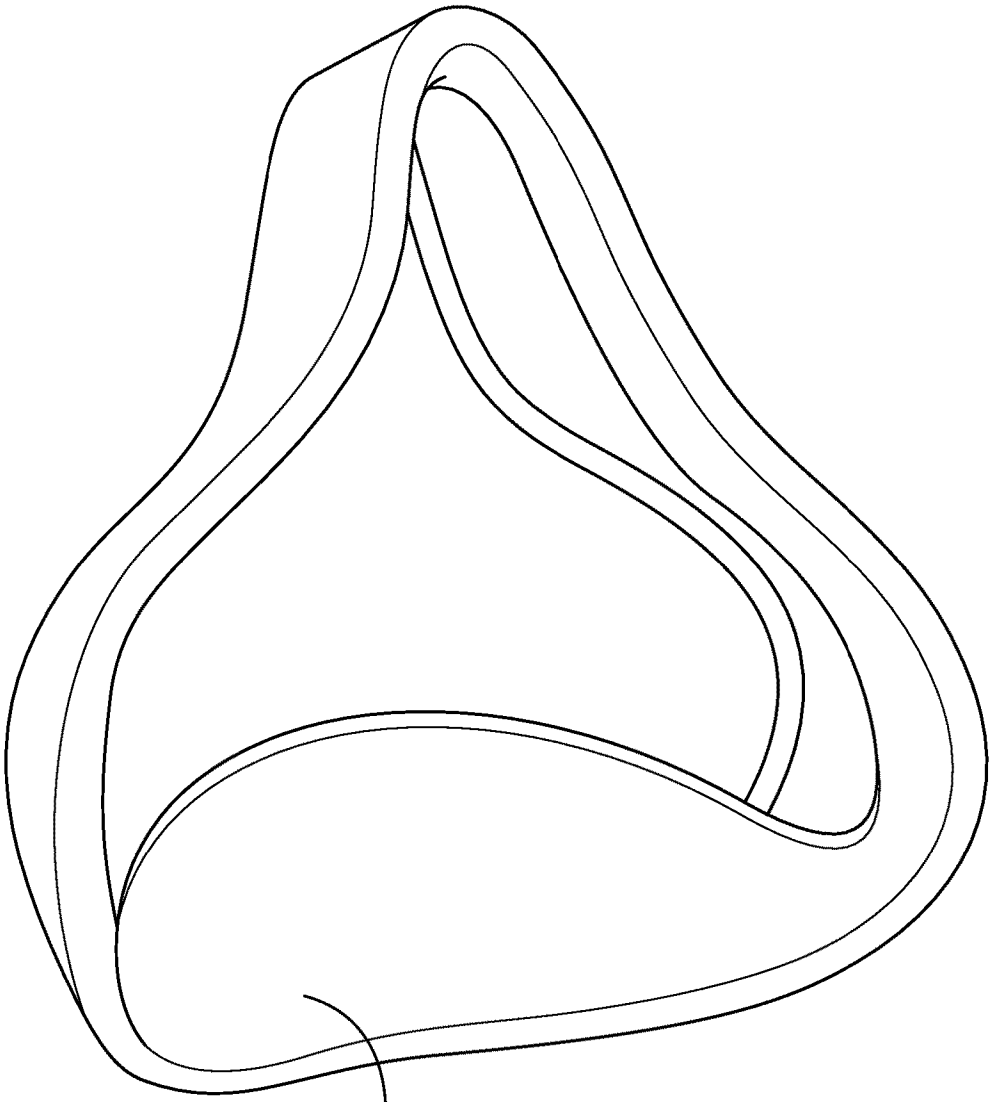
FIGS. 9A and 9B show details of the flange, which is the part of the mask which contacts the face.
Figure 9A:
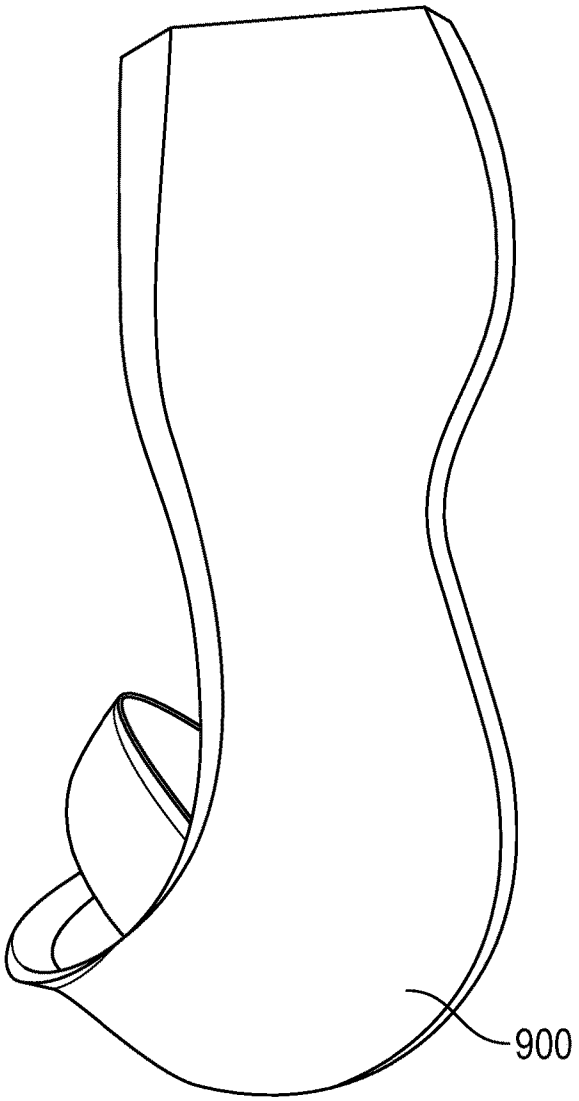

FIG. 9 shows the silicone flange (900) and, in particular, illustrates the lower inside section of the flange, which is shaped to prevent sweat droplets from falling onto the filter material.

In each of the embodiments, the weight of the mask is borne entirely by the swing arms attached to the head-mounted device. This obviates the need to use significant lateral pressure to keep the mask firmly in contact with the face. This contrasts with many conventional masks which use, for example, ear loops or bands around the neck that do use lateral pressure. Reducing the lateral pressure results in a more comfortable mask fit and a better wearing experience.

The inventor found that this also diminishes face marring from the mask. It also allows the mask to use the soft silicon flange (900) around the edge of the mask. Such a flange would crumple and lose its seal if subjected to the lateral pressure that is associated with conventional masks. This further improves the comfort and the user experience.

Moreover, the mask can be easily moved over the user's head to the positions shown in FIGS. 2B, 2C, 5B and 5C, so that the user can drink, eat or take a break from wearing the mask. The mask can be pulled down from that overhead position and repositioned on the face very easily.

With Embodiment M, the mask can be lowered into position and seated on the face with very little effort, in part, because as the mask nears the face the attractive force between the magnet (431/721) and the metal plate (433/724) automatically pulls the mask into place on the face and compresses the flange. The flange is compressed and creates a seal in accordance with the pressure settings set by the user via the adjustment knobs (432/722).

In another embodiment of the mask, FIG. 6, there is a hinged opening on the front of the mask which allows the user to open the front of the mask in order to drink or eat without removing the mask from the face.

The mask system has one or more of the following advantages.

The mask system can prevent or, at least significantly decrease, face marring: using a soft, pliable silicon flange and minimal pressure used to affix the mask to the face.

The mask system provides a comfortable fit on the face by using: a soft, pliable silicon flange and minimal pressure used to affix the mask to the face; hinges on the head-mounted device, elbow joints and axial rotation of mask that allow for exact positioning by wearer so as to maximize comfort; and (in Embodiment M) an adjustable magnetic catch to hold the mask in a position set by the user.

An embodiment of the mask system (i.e., Embodiment M), which employs an adjustable magnetic catch system, keeps the mask positioned on the face and stationary even when the user is engaged in activities involving rapid and irregular body movements, while at the same time maintaining a consistent soft seal between flange and the user's face.

The mask system can prevent the filter from absorbing sweat even under high-activity use: the lower inside section of the flange is shaped to prevent sweat droplets from falling onto the filter material (FIG. 9); also, the shape and structure of the mask and depth of the flange keep the filter material away from the face and exposure to sweat.

The mask system allows the user to easily remove the mask from the user's face and to easily reposition the mask onto the user's face. Swing arms allow the user to easily move the mask away from the face and position it overhead and to easily reposition the mask onto face.

Embodiments, which incorporate (i) silicone or rubber washers at the interface where the upper and lower arms meet to form the elbow joint and/or (ii) a uni-directional joint spanned by a rubber strut in the lower arm, allow the user to open his or her mouth widely without experiencing resistance from the mask.

The swing arms allow the user to easily move the mask away from the face and position it overhead. The swing arms allow the user to easily reposition the mask onto the face. Also, some embodiments will include a hinged or pivoted opening on the mask which can be easily opened and which will provide easy access to the mouth in order, for instance, to eat or drink, while the mask is still in down position.

The mask system provides a sturdy and robust platform that can be used frequently. Embodiments, can be constructed of plastic and silicone and, therefore, can be used regularly without degradation and rinsed off after use. In the case of the home/fitness application (FIG. 7A,7B), the system can include a sweatband that can be removed, washed and eventually replaced; the filter can also be removed, washed and eventually replaced.

Embodiments of the mask system include headwear that a user might in any case wear, such as a bike helmet or a hard hat. The application uses mounts designed specifically for different commonly-used hard hats, and modified swing arms to affix the system to a hard hat.

Bicycle and other sports helmets applications employ mounts designed specifically for different commonly-used helmets and slightly modified swing arms to affix the system to the helmet; in some cases, the system is permanently integrated into helmet, e.g., bicycle helmets.

The mask system can also be used in alternative ways:

Given that the weight of the mask is entirely born by the swing arms, the system can tolerate the addition of other features, e.g., UV disinfectant systems, microphone, earbuds and other audio input, lamp, LED lights for utility and to add decorative flourish, visor, face shield, communication and audio systems, and eye protection; in addition, a more heavy-duty version of the system could be used with a respirator, including a heavy-weight industrial respirator.

The system can be easily adapted for use in conjunction with most helmets.

The system can be used to hold a training mask or high altitude mask.

The home/fitness application (FIG. 7A,7B) can be integrated into a hat or other head covering and hats can be easily designed to integrate into the head harness.

The home/fitness application (FIG. 7A,7B) head harness can double as a hair band and sweat band.

The system is conducive to being automated given that the weight is borne by the head rather than the face.

In operation, the wearer puts on the home/fitness application (FIG. 7A,7B) embodiment like a hat; then adjusts the head harness to the desired tightness. With the hard hat and helmet application, the wearer simply puts on the hard hat or helmet. In all applications, the wearer then positions the mask onto his or her face and (i) the tension supplied by the joints keep the flange seated on the face or (ii) with Embodiment M, the magnetic catch system keeps the flange seated on the face. Because the flange is deep and soft, it can be compressed slightly with minimum pressure. The result is that a good seal and comfortable fit can be achieved with a wide range of face types and (i) just the pressure achieved by the tension in the joints or (ii) in the case of Embodiment M, the stationary hold effected by the magnetic catch system. The fixed position effected by either the tension in the joints or the magnetic catch system can be easily overcome by the user in order to remove the mask from the face.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A mask system, comprising:

a headmounted device, having surfaces holding the headmounted device to a head of a user;

a mask, formed of a filtering material, that is a material through which a user can breathe, and which filters through the filtering material, the mask having surfaces configured to cover a nose and mouth of the user and to form a sealing surface around the nose and mouth of the user;

a set of swing arms, connected at one end to the headmounted device, and connected at a second end to the mask; the swing arms holding the mask relative to the headmounted device, and configured to bear a weight of the mask being held by the headmounted device; and a pivot system, allowing pivoting of the swing arms, whereby the swing arms pivot between a first position where the mask is covering the nose and mouth of the user and seals around the nose and mouth of the user in a way that causes the user to breathe through the filtering material of the mask, and a second position where the mask is removed from the nose and mouth of the user.

2. A mask system, comprising:

a headmounted device, having surfaces holding the headmounted device to a head of a user:

a mask, having surfaces configured to cover a nose and mouth of the user;

a set of swing arms, connected at one end to the headmounted device, and connected at a second end to the mask; the swing arms holding the mask relative to the headmounted device, and configured to bear a weight of the mask being held by the headmounted device; and a pivot system, allowing pivoting of the swing arms, whereby the swing arms pivot between a first position where the mask is covering the nose and mouth of the user, and a second position where the mask is removed from the nose and mouth of the user, wherein the swing arms can pivot into numerous intermediate positions, starting from a first position in which the mask is seated on a face of the user to force the user to breathe through the mask, to a second position in which the mask is raised up and held fast just above a visual field of the user to a third position in which the mask is moved behind the headmounted device and stowed away in a fixed position.

3. The system as in claim 1, wherein the swing arms include a first swing arm on a first side, attaching between a first side of the mask and a first side of the headmounted device, and a second swing arm attaching between a second side of the mask and a second side of the headmounted device.

4. The system as in claim 1, wherein each swing arm has a first pivot point on the headmounted device and a second pivot point on the swing arm between the first end and the second end of the swing arm, the first pivot point controlling a position of an upper part of the swing arm and the second pivot point separately controlling the position a lower part of the swing arm.

5. The system as in claim 3, wherein a third pivot point located where the lower arm of each swing arm connects to the mask allows the mask to rotate axially thereby allowing for fine-tuned adjustment of the mask by the user.

6. A mask system, comprising:

a headmounted device, having surfaces holding the headmounted device to a head of a user;

a mask, having surfaces configured to cover a nose and mouth of the user;

a set of swing arms, connected at one end to the headmounted device, and connected at a second end to the mask; the swing arms holding the mask relative to the headmounted device, and configured to bear a weight of the mask being held by the headmounted device; and a pivot system, allowing pivoting of the swing arms, hereby the swing arms pivot between a first position where the mask is covering the nose and mouth of the user, and a second position where the mask is removed from the nose and mouth of the user, wherein the mask includes a flange that forms a perimeter surface that covers the nose and mouth of the user, and a mask frame that mates with the surface of the flange and which holds a filter.

7. The system as in claim 1, wherein the mask frame is comprised of a flange, a first frame that holds the filter and a second frame that mates with the flange, and a hinge, where the first frame and the second frame are connected by the hinge, which allows a front of the mask to be pivoted downward to form an opening to the user's mouth, without removing the flange from a face of the user.

8. The system as in claim 1, wherein the headmounted device is one of a head harness, hard hat, or helmet.

9. The system as in claim 4, wherein each swing arm is configured to enable the mask to move from a first position where the mask is seated on a face and the user is caused to breathe through the mask, to a second position where the mask is lifted to the same height as the first pivot point and held fast.

10. The system as in claim 9, wherein each swing arm moves with minimal resistance from the first position to the second position, where the swing arms are held stationary, and moves from the second position to a third position where the mask is stowed and held fast behind the headmounted device.

11. The system as in claim 9, wherein each swing arm has magnetic connection parts, which magnetically hold the swing arms stationary in a down position where the mask is seated on a face of the user, an intermediate position where the mask lifted just above a visual field of the user and a final position where the mask is stowed away behind the head-mounted device and which can be adjusted by the user to fine tune a position of the mask and a tightness of the mask on the face of the user when the mask is in the down position.

12. The system as in claim 10, wherein each swing arm includes first and second surfaces, which move relative to one another with minimal resistance from the first position to the second position, and press against one another as the swing arms move into the second position, thus holding the swing arms and mask in a stationary position just above a visual field of the user.

13. A method of holding a mask relative to a user's face, comprising:

attaching a headmounted device to a head of a user;

attaching a mask, having surfaces configured to cover a nose and mouth of the user, to a second end of a pair of swing arms;

attaching first ends of the swing arms to the headmounted device;

configuring the swing arms to bear 100% of a weight of the mask being held by the headmounted device; and pivoting of the swing arms between a first position where the mask is covering the nose and mouth of the user, a second position where the mask is removed from the nose and mouth of the user and held fast above a visual field of the user, and a third position where the mask is moved behind the headmounted device in a stowed away position.

14. The method as in claim 13, wherein the swing arms include a first swing arm on a first side, attaching between a first side of the mask and a first side of the headmounted device, and a second swing arm attaching between a second side of the mask and a second side of the headmounted device, and the swing arms each include a pivot which pivots between the first end and the second end of the swing arms.

15. The method as in claim 14, wherein the pivoting uses first pivot points between the headmounted device and upper parts of the swing arms, which cause the upper parts of the pivot arms to pivot separately from second pivot points between the upper parts of the swing arm, and lower parts of the swing arms, which cause the lower arms to pivot separately from a pivot effected by the first pivot points.

16. The method as in claim 15, wherein third pivot points between the lower arms and the mask allow the mask to rotate axially on the pivot points, thus allowing for a greater degree of adjustment by the user.

17. The method as in claim 16, wherein the mask frame has a filter, a flange, a first frame that holds the filter and a second frame that mates with the flange; comprising hinging between the first and second frame to pivot a front of the mask downward to form an opening to the user's mouth, without removing the flange from the face.

18. The method as in claim 13, wherein the headmounted device is one of a head harness, hard hat, or helmet.

19. The method as in claim 15, wherein each swing arm is configured to enable the mask to move from a first position where the mask is seated on the face, to a second position where the mask is lifted to a same height as the first pivot points and held fast.

20. The method as in claim 19, wherein each swing arm moves with minimal resistance from the first position to the second position, where the swing arms are held stationary, and moves from the second position to a third position where the mask is stowed and held fast behind the headmounted device.

21. The method as in claim 19, wherein each swing arm has magnetic connection parts, which magnetically hold the swing arms stationary in a down position with the, mask seated on the user's face, an intermediate position with the mask lifted just above a visual field of the user and a final position where the mask is stowed away behind the head-mounted device and which can be adjusted by the user to fine tune the position of the mask and a tightness of the mask on the user's face when the mask is in the down position.

22. The method as in claim 19, wherein each swing arm includes first and second surfaces, which move relative to one another with minimal resistance from the first position to the second position, and press against one another as the swing arms move into the second position, thus holding the swing arms and mask in a stationary position just above the visual field of the user.

* * * * *